US005706786A

United States Patent [19]

Stephanus et al.

[11] Patent Number: 5,706,786

[45] Date of Patent: Jan. 13, 1998

[54] DISTORTION REDUCING LOAD RING FOR A FUEL INJECTOR

[75] Inventors: Tony L. Stephanus, Columbus; Donald J. Stephanus, Lexington; Estill Ratliff, E-Town, all of Ind.

[73] Assignee: Cummins Engine Company, Inc., Columbus, Ind.

[21] Appl. No.: 365,559

[22] Filed: Dec. 28, 1994

[51] Int. Cl.[6] ..... F02M 55/02

[52] U.S. Cl. ..... 123/470; 123/509

[58] Field of Search ..... 123/509, 470, 123/456, 472

[56] References Cited

U.S. PATENT DOCUMENTS

| | | | |
|---|---|---|---|
| 3,387,867 | 6/1968 | Rogers . | |
| 4,066,213 | 1/1978 | Stampe | 123/470 |
| 4,133,321 | 1/1979 | Hofmann et al. . | |
| 4,403,586 | 9/1983 | Taniguchi . | |
| 4,419,977 | 12/1983 | Hillebrand . | |
| 4,519,371 | 5/1985 | Nagase et al. . | |
| 4,528,959 | 7/1985 | Hauser, Jr. . | |
| 4,571,161 | 2/1986 | Leblanc et al. . | |
| 4,648,556 | 3/1987 | Leblanc et al. . | |
| 4,829,646 | 5/1989 | Cigolotti et al. . | |
| 4,917,069 | 4/1990 | Kuhleo | 123/509 |
| 4,938,193 | 7/1990 | Raufeisen et al. . | |
| 5,121,731 | 6/1992 | Jones . | |
| 5,308,038 | 5/1994 | McArthur | 123/456 |

FOREIGN PATENT DOCUMENTS

| | | | |
|---|---|---|---|
| 0022926 | 1/1981 | European Pat. Off. . | |
| 0369151 | 5/1990 | European Pat. Off. | 123/470 |
| 838650 | 3/1939 | France . | |
| 3010328 | 9/1981 | Germany | 123/470 |
| 57-0070952 | 5/1982 | Japan | 123/470 |
| 59-0074368 | 4/1984 | Japan | 123/470 |
| 4128551 | 4/1992 | Japan | 123/470 |
| 1550204 | 3/1990 | U.S.S.R. . | |
| 1549740 | 8/1979 | United Kingdom | 123/470 |
| 2 177 157A | 6/1985 | United Kingdom . | |
| 2 177 450A | 6/1986 | United Kingdom . | |
| WO 84/02161 | 6/1984 | WIPO . | |
| WO 87/00246 | 1/1987 | WIPO . | |

*Primary Examiner*—Carl S. Miller

*Attorney, Agent, or Firm*—Woodard, Emhardt, Naughton, Moriarty & McNett

[57] ABSTRACT

A distortion reducing load ring disposed and connected between a fuel injector and a clamping device. The load ring functions as an intermediary for transmitting a static clamping load from the clamping device to the fuel injector body. The load ring includes a substantially cylindrical shaped main body having a bore extending therethrough between an upper portion and a lower portion. The upper portion of the main body being adapted for receiving a clamping load from the clamping device. The lower portion defining an annular ring for contacting the upper surface of the fuel injector body. A convex shaped portion connecting between the lower portion and the upper portion for increasing the resistance to bending of the load ring. The geometric relation of the load ring is utilized to transfer the static clamping load from the clamping device to a substantially central region of the fuel injector body. By transferring the static clamping load to a more central region of the fuel injector body there is a corresponding reduction in the failure rate of fuel injector units.

25 Claims, 3 Drawing Sheets

DISTORTION REDUCING LOAD RING FOR A FUEL INJECTOR

BACKGROUND OF THE INVENTION

The present invention relates in general to the design and construction of clamping rings which are used as an intermediary for transmitting static clamping loads from a clamping device to an object. More particularly, the present invention relates to a clamping load distributor utilized as an intermediary for holding a fuel injector body to the cylinder head of an internal combustion engine.

Many internal combustion engines, whether compression ignition or spark ignition engines, are provided with fuel injection systems to satisfy the need for precise and reliable fuel delivery into the combustion chamber of the engine. Such precision and reliability is necessary to address the goals of increasing fuel efficiency, maximizing power output, and controlling the undesirable by-products of combustion.

A unit injector is a precision device that must meter the quantity of fuel required for each cycle of the engine and must develop the high pressure necessary to inject the fuel into the combustion chamber at the correct instant of the operating cycle. Many fuel injection units utilize a mechanical linkage from the engine, such as a push rod and rocker arm, to pressurize the fuel charge and obtain the desired fuel spray pattern. The mechanical linkage interacts with a timing plunger that is disposed within a bore formed in the fuel injector for engaging an incompressible liquid fuel. This mechanical pressurization of the liquid fuel produces an extremely high fuel injection pressure, often exceeding 20,000 p.s.i. (13,800 Newtons per square centimeter).

In the past, designers of internal combustion engines have generally used a mechanical clamping device to hold a fuel injection unit on the cylinder head. One approach is to affix a clamping device, having a wishbone shaped fork at one end, to the cylinder head. The clamping device is bolted to the cylinder head. The forks on the wishbone shaped end contact the top surface of the fuel injector body in two places, thereby holding the fuel injector unit in place. A second approach is to utilize a clamping plate that engages a flange formed on the outer perimeter of the fuel injector body. The clamping plate is secured to the engine by one, or a pair of bolts, thereby drawing the flange against the engine block and holding the fuel injector unit in place.

These two approaches of fastening a fuel injector unit to an internal combustion engine have a common limitation. The common limitation being that the mechanical clamping device imparts a concentrated clamping force to a portion of the fuel injector body. Premature failure of the fuel injector unit is often attributed to the fuel injector body receiving a concentrated clamping load. The concentrated clamping forces distort the precision bores formed internal to the injector. Sliding clearance must be maintained on moving components inside the injector. The clamping load distortion necessitates an increase in the "match clearance" in the "pre-distorted state" (i.e. during the manufacturing process) to compensate for the reduced clearance during operation. This contributes to "timing plunger scuffing," and requires that excessive clearance be designed into the product.

During engine operation this excessive clearance allows "blow-by" and leakage past the plunger. This problem associated with excessive clearance must be addressed in order to effectively utilize alternate materials such as ceramics. Alternate materials having diverse coefficients of thermal expansion cause the "match clearance" to widen as thermal expansion of the parts occurs. The ability to reduce and control "match clearances" internal to the fuel injector allows the use of alternate fluids to drive the timing plungers. Current technology uses "diesel fuel" as a lubricant and a hydraulic medium to drive the injection pressures. The timing plungers can be driven and lubricated with alternative fluids such as engine lubricating oil, alcohol, gasoline, etc. The reduced match clearances advance the state of the art in fuel injector units.

In order to try and solve, or at least minimize, the foregoing problem, designers have tried different approaches. For example, there have been a variety of clamping rings, for transferring static clamping loads produced by clamping devices conceived of over the years. The following listing of references is believed to be representative of such earlier designs.

REFERENCES

| Patent No. | Patentee | Issue Date |
|---|---|---|
| 4,829,646 | Cigolotti et al. | May 16, 1989 |
| 4,571,161 | Leblanc et al. | Feb. 18, 1986 |
| 4,419,977 | Hillenbrand | Dec. 13, 1983 |
| 4,403,586 | Taniguchi | Sept. 13, 1983 |
| 3,387,867 | Rogers | June 11, 1968 |
| **Patent No.** | **Applicant** | **Date** |
| French No. 838,650 | Fives-Lille Company | March 10, 1939 |

Even with a variety of earlier designs, there remains a need for a distortion reducing load ring that is easy to install and addresses the clamping distortion attributed to the transmission of a concentrated clamping force to the fuel injector body, thereby reducing the distortion of the bore formed in the fuel injector body. The present invention satisfies this need in a novel and unobvious way.

SUMMARY OF THE INVENTION

Figure 1:
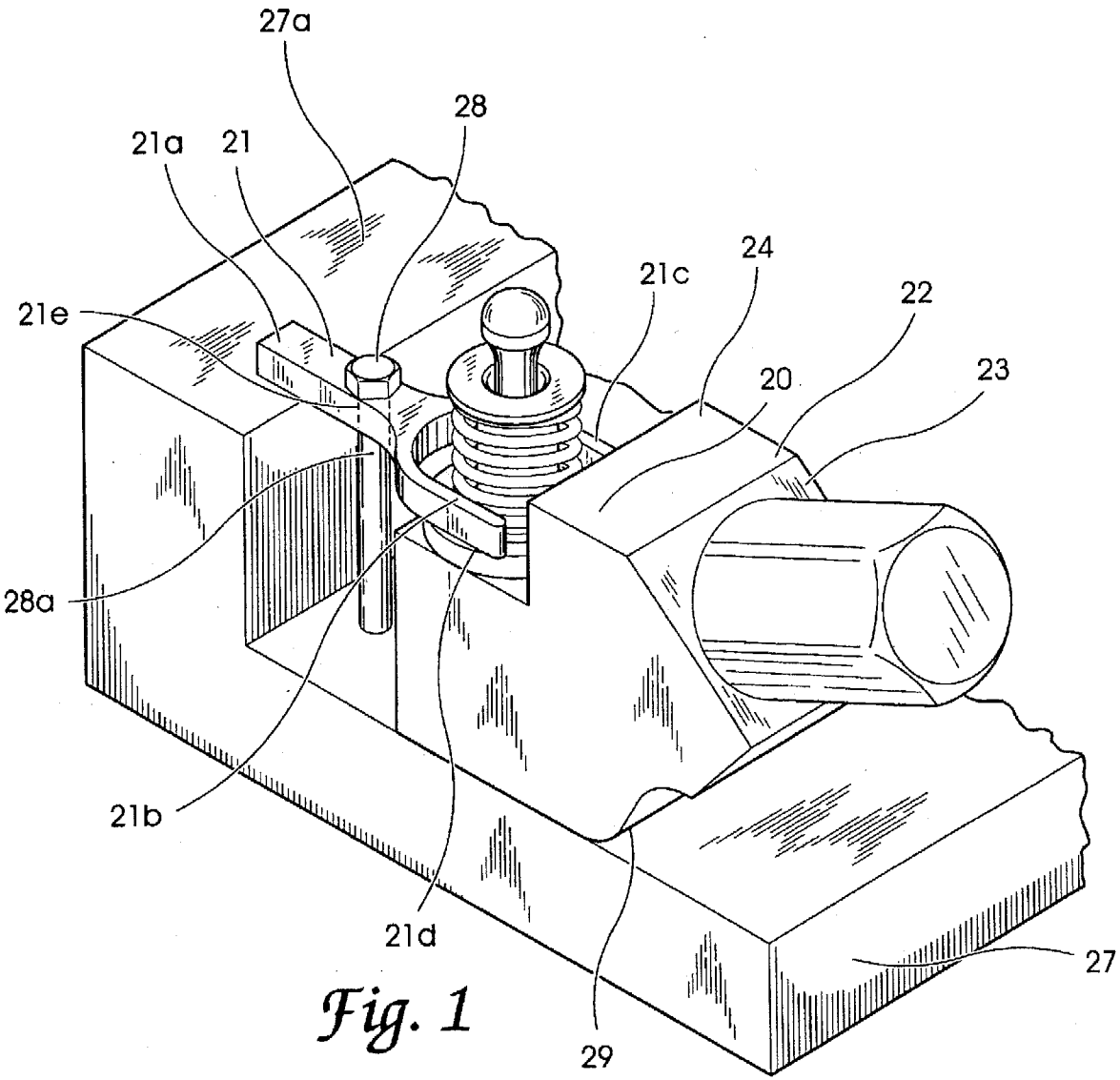
FIG. 1 is a perspective view of a distortion reducing load ring according to a typical embodiment of the present invention as assembled between a fuel injector body and a wishbone clamp.

To address the unmet needs of prior fuel injector unit mounting devices, the present invention contemplates a load ring disposed between a fuel injector body and a clamping device, the load ring comprising: a body having a first portion and a second portion opposite to the first portion, the first portion positioned for receiving a clamping load from the clamping device, the first portion having a first radial width, the second portion constructed and arranged for contacting the fuel injector body, the second portion having a second radial width, wherein the second radial width is smaller than the first radial width, and a convex portion connecting between the first portion and the second portion.

One object of the present invention is to provide an improved distortion reducing load ring for fastening a fuel injector body on the cylinder head of an internal combustion engine.

Related objects and advantages of the present invention will be apparent from the following description.

DESCRIPTION OF THE PREFERRED EMBODIMENT

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
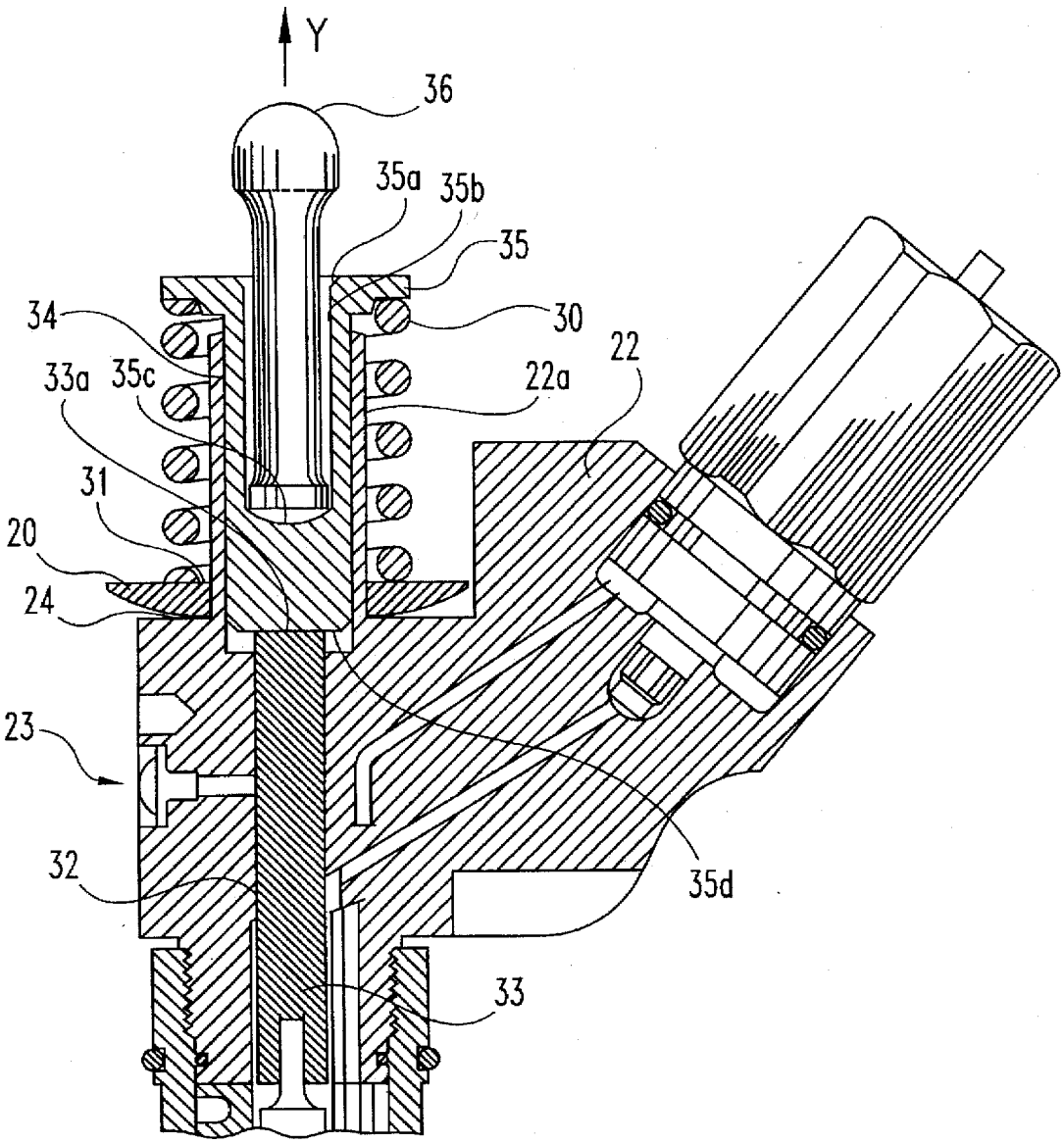
FIG. 2 is a front elevational view in full section of the FIG. 1 distortion reducing load ring as assembled on the fuel injector body with the wishbone clamp removed.

Referring to FIGS. 1 & 2, there is illustrated a distortion reducing load ring 20 which is designed and manufactured in accordance with the present invention. Distortion reducing load ring 20 is designed to reduce the concentrated point loading inherent with a hold down clamp 21, and transfer the static clamping load radially inward toward a central axis Y, or at least on lines parallel to central axis Y of the fuel injector body 22. The distortion reducing load ring 20 is positioned on the fuel injector unit 23 between the upper surface 24, of the fuel injector body 22, and the hold down clamp 21.

The hold down clamp 21 is provided for securing the fuel injector body 22 to a cylinder head 27 of an internal combustion engine (not illustrated). In the preferred embodiment the hold down clamp 21 includes a first end 21*a* that contacts upper surface 27*a* of the cylinder head 27. The second opposite end of the hold down clamp 21 defines a pair of forks 21*b* and 21*c* that are formed in a spaced apart relationship with each other. A coplanar lower surface 21*d* of the pair of forks 21*b* and 21*c* is positioned to contact the load ring 20 when the hold down clamp 21 is mounted to the cylinder head 27. A threaded fastener 28 includes a shaft portion 28*a* that passes through a clearance hole 21*e* formed in the body of the hold down clamp 21. In the preferred embodiment the threaded fastener is a hex head bolt 28. It is further contemplated that the fastener could alternatively be a threaded rod and nut combination. The bolt 28 engages an internally threaded bore formed in the cylinder head 27. The torquing of bolt 28 transmits a hold down clamp static load through the forks 21*b* and 21*c* to the clamping load distributor 20, thereby holding the fuel injector body 22 against a deck 29 of cylinder head 27.

With further reference to FIG. 2, there is illustrated the fuel injector unit 23 having load ring 20 positioned around a portion of the outer circumference of coupling return spring 30, and contacting the upper surface 24 of fuel injector body 22. The fuel injector body 22 is formed preferably as a forged unit that includes an upstanding cylindrical portion 22*a*, and a central axial cavity 31 extending throughout the length of the fuel injector body 22. The axial cavity 31 is actually comprised of two coaxial and communicating cylindrical bores of different inner diameters. In the preferred embodiment the first cylindrical bore 32 is machined to within 0.000039 inch cylindricity in the fuel injector body 22 and slideably receives a timing plunger 33. At this level of precision, any distortion of the cylindrical bore 32 is detrimental to the lubrication of the timing plunger 33.

The timing plunger 33 in the preferred embodiment is formed from steel, however in an alternate embodiment the timing plunger 33 is formed of ceramic. The second cylindrical bore 34 is defined in the upstanding cylindrical portion 22*a* of the fuel injector body 22 and slideably receives a coupling member 35. At the exposed portion 35*a* of the coupling member 35, a bore 35*b* and a load bearing surface 35*c* are formed. A link 36 is disposed within the bore 35*b* and contacts the load bearing surface 35*c* for transmitting a force to the coupling member 35, to overcome the spring force of coupling return spring 30. The link 36 functions in a well known fashion and is typically in contact with a valve train camshaft (not illustrated) of the internal combustion engine. Link 36 reciprocates along the central axis Y in response to the angular position of the actuating valve train camshaft.

The coupling member 35 defines a lower surface 35*d* that is contactable with an upper surface 33*a* of timing plunger 33. In the preferred embodiment there is no mechanical fixation or attachment between the coupling member 35 and the timing plunger 33; only a compressive load is transmitted from the coupling member 35 to the timing plunger 33. However, in another embodiment there is mechanical attachment between the coupling member and the timing plunger. The compressive load transmitted from the coupling member 35 to the timing plunger 33 causes the axial movement of the timing plunger 33 which functions to pressurize a fuel charge disposed within the fuel injector unit 23.

Figure 3:
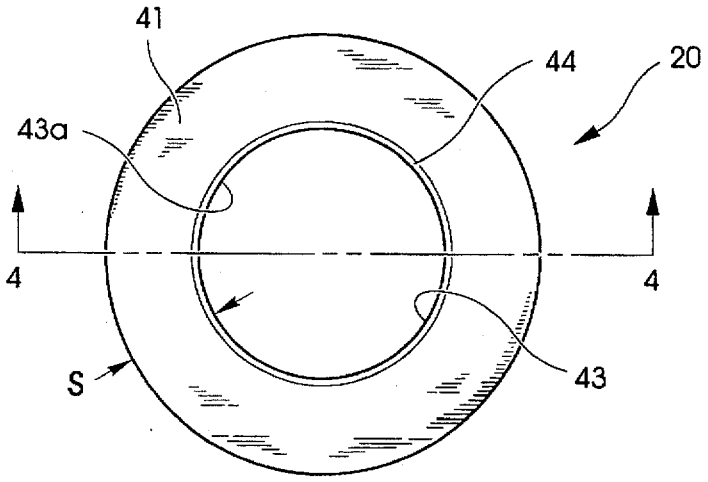
FIG. 3 is a top plan view of the FIG. 1 distortion reducing load ring.
Figure 4:
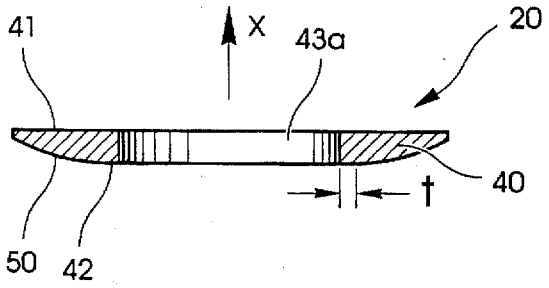
FIG. 4 is a side elevational view in full section taken along line 4—4 of the FIG. 3 distortion reducing load ring.
Figure 5:
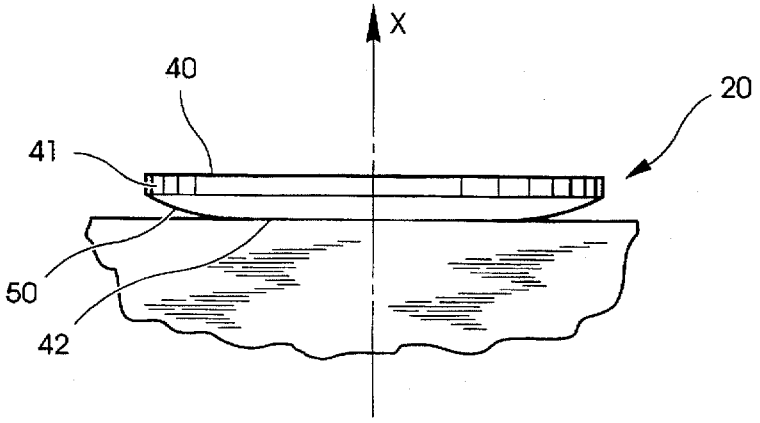
FIG. 5 is a side elevational view of the FIG. 1 distortion reducing load ring connected to a fuel injector body.

Referring to FIGS. 3–5, there is illustrated the load ring 20 having a substantially cylindrical main body 40. In the preferred embodiment the load ring 20 is of a unitary design and is formed from a steel blank. A predetermined amount of material is removed from the steel blank, by a machining process which utilizes a turning operation, a milling operation, and a grinding process to produce the desired geometric configuration described hereinafter. In the preferred embodiment the load ring 20 is of hardened steel. Preferably the load ring has a hardness in the range of about Rockwell 50–55 C. Alternatively, the load ring 20 can be formed by any other suitable manner which provides a durable ring with the desired dimensions, such as by a sintered powder metal process or forging.

The main body 40 of the load ring 20 includes a substantially flat, first upper portion 41, and a substantially flat, second lower portion 42 that is disposed opposite of the first upper portion 41. The first upper portion 41 and the second lower portion 42 are formed substantially parallel to each other. In the preferred embodiment the first upper portion 41 is parallel to the second lower portion 42 within a tolerance of about 0.001 inch. The second lower portion 42 is disposed between a pair of spaced apart reference lines, which are parallel to the first upper portion 41. The reference lines are spaced apart 0.001 inch. The main body 40 of load ring 20 has an aperture 43 extending therethrough between the first upper portion 41 and the second lower portion 42. An internal diameter surface 43*a* is defined on aperture 43, and this internal diameter surface 43*a* is larger than the outside diameter of the coupling return spring 30 that is disposed circumferentially around the upstanding cylindrical portion 22*a* of the fuel injector body 22. This relative difference in diameter size permits the load ring 20 to be placed during assembly circumferentially around the coupling return spring 30.

The load ring 20 includes a longitudinal centerline X. In the preferred embodiment the main body 40 is substantially symmetrical about the central longitudinal axis X. The symmetry of the load ring allows for the ease of assembly because there is no requirement to radially position the load ring 20 before connecting the hold down clamp 21 thereto. The first upper portion 41 of the main body 40 is formed substantially transverse to the longitudinal centerline X of the load ring 20 and is adapted for receiving the forks **21*b* and 21*c* of hold down clamp 21. A static clamping load is transmitted from forks 21*b* and 21*c* to the load ring 20. In the preferred embodiment the first upper portion 41 defines a planar surface having a first radial width "s". In the preferred embodiment the first upper portion 41 defines a first annular ring. A slight chamfer 44 is formed at the junction of the aperture 43 and the first upper portion 41. The use of the slight chamfer 44** is generally known to a person skilled in the art for eliminating the negative ramifications of a sharp corner.

The second lower portion 42 contacts the upper surface 24 of the fuel injector body 22. In the preferred embodiment the second lower portion 42 defines a second annular ring having a radial width "t" of about 1/32 of an inch. It should be understood that second annular rings having other dimensions are contemplated. In the preferred embodiment the second lower portion 42 has a radial width "t" that is smaller than the radial width "s" of the first upper portion 41. Further, in the preferred embodiment the ratio of the radial width "s" of the first upper portion 41 to the radial width "t" of the second lower portion 42 is at least about 11:1. The above geometrical relationship between the first upper portion 41 and the second lower portion 42 results in the transfer of the concentrated static clamping load from the hold down clamp 21 to the upper surface 24 of the fuel injector body 22. The load ring 20 is utilized to direct the static clamping load radially inward from the hold down clamp 21 to a location parallel to the longitudinal centerline X; the location being aligned with the second lower portion 42. The movement of the clamping load towards the center of the fuel injector body 22 results in a significant decrease in the distortion of the first cylindrical bore 32 which has timing plunger 33 slideably disposed within. By decreasing the distortion of the first cylindrical bore 32 there is a corresponding reduction in the scuffing of the timing plunger 33. The reduction of timing plunger 33 scuffing minimizes or eliminates the current of timing plunger seizure.

An annular portion 50 is formed on the main body 40 and connects the first upper portion 41 and the second lower portion 42. The annular portion 50 has a convex shape thereto, and in the preferred embodiment the convex shape is substantially spherical. However, other convex shapes including hyperbolic, parabolic, and elliptical are contemplated in other embodiments. In the preferred embodiment the convex shape is formed by machining a sphere with a radius of 2.0 inches on the lower part of the steel blank. A surface grinding operation is then performed to produce the second annular ring 42. The surface grinding operation produces a precision flat surface on the main body 40 having a surface finish in the range of about 40–50 micro inches. The annular portion 50 being of a convex shape increases the load ring's 20 resistance to bending when the clamping load is applied. Further, the annular portion 50 is formed on the main body 40 radially outward of the second annular ring 42. In the preferred embodiment the annular portion 50 is formed adjacent the second annular ring 42 and continues outwardly to the cylindrical edge 51 of the main body 40.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A load ring disposed between a fuel injector body and a clamping device, said load ring comprising:

a body having a first portion and a second portion opposite to said first portion;

said first portion positioned for receiving a clamping load from the clamping device, said first portion having a first radial width;

said second portion constructed and arranged for circumferentially contacting the fuel injector body, said second portion having a second radial width, wherein the second radial width is smaller then the first radial width for transferring the clamping load radial inward from the said first portion; and a convex portion extending between and connecting said first portion and said second portion.

2. The load ring recited in claim 1, wherein said body having a substantially central longitudinal axis, and wherein said body being substantially symmetrical about the central longitudinal axis.

3. The load ring recited in claim 2, wherein said body is substantially cylindrical.

4. The load ring recited in claim 3, wherein said body defines an aperture extending between said first portion and said second portion for receiving at least a portion of the fuel injector body therethrough.

5. The load ring recited in claim 4, wherein said first portion is substantially parallel to said second portion.

6. The load ring recited in claim 5, wherein said first portion is a first annular ring, and wherein said second portion is a second annular ring.

7. The load ring recited in claim 6, wherein said first portion is parallel to said second portion within about 0.001 inch.

8. The load ring recited in claim 7, wherein said first portion being formed substantially transverse to the central longitudinal axis.

9. The load ring recited in claim 8, wherein said second annular ring having a radial width of 1/32 inch.

10. The load ring recited in claim 9, wherein said convex portion being substantially spherical.

11. The load ring recited in claim 10, wherein said convex portion having a radius of about 2.0 inches.

12. The load ring recited in claim 11, wherein said convex portion being situated radially outward from said second annular ring.

13. The load ring recited in claim 12, wherein said body being of hardened steel.

14. The load ring recited in claim 13, wherein said body having a hardness in the range of about 50–55 Rockwell C.

15. The load ring recited in claim 1, wherein said convex portion being substantially spherical.

16. The load ring recited in claim 1, wherein the ratio of the width of the first annular ring to the width of the second annular ring is at least about 11:1.

17. In combination:

a fuel injector body;

a cylinder head;

a clamping means connected to the cylinder head for holding said fuel injector body to said cylinder head; and a load ring comprising:

a substantially cylindrical body having an upper surface and a lower surface opposite said upper surface;

said upper surface for receiving said clamping means, said upper surface having a first radial width;

said lower surface constructed and arranged for contacting said fuel injector body, said lower surface having a second radial width, said first radial width being larger than said second radial width; and a convex surface connecting between said upper surface and said lower surface for increasing said body's resistance to bending under said clamping load.

18. The combination recited in claim 17, wherein said body having a substantially central longitudinal axis, and wherein said body having an aperture extending between said upper surface and said lower surface.

19. The combination recited in claim 18, wherein said upper surface defining a first ring disposed symmetrically around the substantially longitudinal axis, and wherein said lower surface defining a second ring disposed symmetrically around the substantially central longitudinal axis.

20. The combination of claim 19, wherein said first ring extending radially outward from the substantially central longitudinal axis further than said second ring.

21. The combination of claim 20, wherein said convex surface being substantially spherical.

22. The combination of claim 21, wherein said convex surface positioned radially outward from said second ring.

23. The combination of claim 22, wherein said body being of hardened metal.

24. The combination of claim 23, wherein the ratio of the radial width of the first ring to the radial width of the second ring being at least about 11:1.

25. The combination of claim 24, wherein said first ring being substantially parallel to said second ring.

* * * * *